United States Patent [19]

Sjöstrand et al.

[11] 4,036,085

[45] July 19, 1977

[54] HANDLE STRUCTURE FOR PERCUSSIVE TOOLS

[75] Inventors: Fritiof Stig Sjöstrand, Los Angeles, Calif.; Anders Gunnar Rudolf Lundmark, Stockholm; Gosta Ivar Ekström, Nacka, both of Sweden

[73] Assignee: Atlas Copco Aktiebolag, Nacka, Sweden

[21] Appl. No.: 659,033

[22] Filed: Feb. 18, 1976

[30] Foreign Application Priority Data

Feb. 18, 1975 Sweden ..... 7501818

[51] Int. Cl.[2] ..... B25B 19/00

[52] U.S. Cl. ..... 81/52.3; 173/162; 173/169

[58] Field of Search ..... 81/52.3; 173/162, 169; 16/116 R, 116 A; 74/551.9

[56] References Cited

U.S. PATENT DOCUMENTS 3,010,431 11/1961 Holdo ..... 173/162

FOREIGN PATENT DOCUMENTS 1,221,709 1/1960 France ..... 74/551.9

707,279 4/1931 France ..... 74/551.9

*Primary Examiner*—James L. Jones, Jr.

*Attorney, Agent, or Firm*—Flynn & Frishauf

[57] ABSTRACT

A handgrip in a handle structure for hammer tools comprises a wing-shaped portion for applying a thrust force on the tool. The force of the recoil which occurs when impacts are delivered is absorbed by the mass of the hand and arm and by the resilience of the limbs of said parts of the body. To advantage, the handgrip is turned when the pressure-applying-grip is changed to a lifting-grip.

25 Claims, 18 Drawing Figures

HANDLE STRUCTURE FOR PERCUSSIVE TOOLS

This invention relates to a handle structure for percussive tools having a surface which rests against a hand during operation of the tool for applying pressure on the tool in the longitudinal direction thereof.

A handle of a percussive tool has to fulfil several different functions. It shall provide a grasp for making possible applying of a feed force to the tool during operation and provide a grasp for lifting the tool when the working area is changed. It must also be possible to direct the tool toward the material to be worked and to hold the tool in connection with transportation thereof.

The design of the handle is determined by certain anatomical and physiological conditions which make it possible to adapt the design such that the hand and arm can be prevented from being exposed to unnecessary fatigue and injury.

One object of the invention is to provide a handle having a grasp for applying pressure downwards and for directing the tool, said grasp being designed such that the force of the recoil which occurs when impacts are delivered is directed such that it is absorbed by the mass of the hand and arm and by the resilience of the articulations of said parts of the body.

Another object of the invention is to distribute the force of the recoil on the highest possible contact surface in order to expose the tissues of the hand to the smallest possible fluctuation of pressure as measured per unit of volume of the tissue.

A further object of the invention is to provide the handle with a grasp for lifting the tool, said lifting-grasp being spaced from the pressure-applying-grasp, wherein the grasp is changed from pressure to lift and vice versa by means of as small a movement of the hand as possible.

The above and other purposes of the invention will become apparent from the following description with reference to the accompanying drawings, in which several embodiments of the invention are shown by way of example. It is to be understood that these embodiments are only illustrative of the invention and that various modifications thereof may be possible within the scope of the claims following hereinafter.

DETAILED DESCRIPTION

Figure 12:
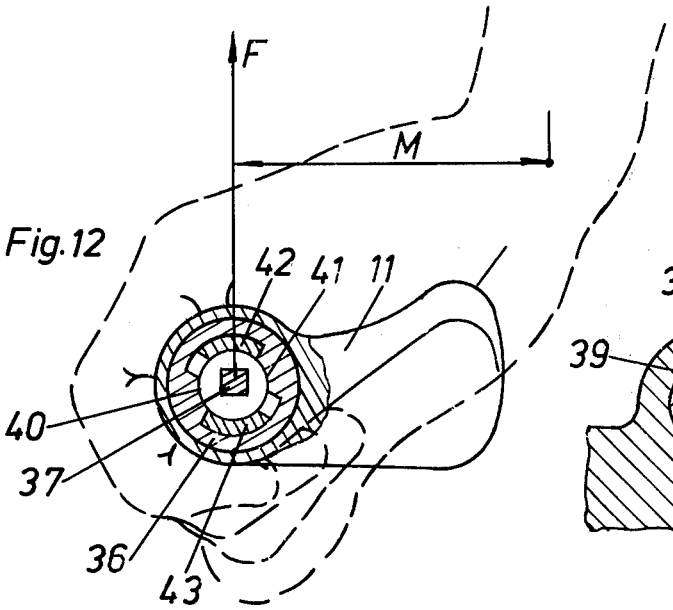
FIG. 12 is a section on the line A—A in FIG. 11.
Figure 13:
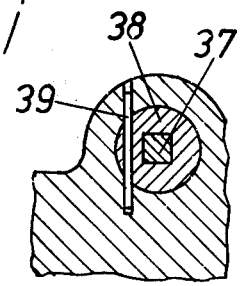
FIG. 13 is a section on the line B—B in FIG. 11.

The main principles which a handle according to this invention has to fulfill are as follows:

The force of the recoil must be directed such that it is absorbed by the mass of the hand and arm and by the resilience of the articulations of these parts of the body. By this is avoided that the force acts directly on the skeleton parts along the longitudinal axes thereof. That is possible if the direction of the force is eccentric relative to the axes of the articulations. This means, as regards the wrist, that the articulation has to be stretched (FIGS. 12, 15 and 17) and that the force has to be applied as far as possible, i.e. distally outwards the heads of the bones of the metacarpus. The moment arm (M in FIG. 12 of the recoil force then becomes long and the moving range in the wrist becomes therefor as small as possible for a certain amplitude of the recoil movement. The wrist is thus relieved of direct load. Instead, the muscles of the arm are activated to maintain the wrist in this position. That is what is aimed to because the muscles can act as damping springs during these conditions. At the same time the mass of the hand and the arm is used for absorbing the movement of the recoil.

Figure 18:
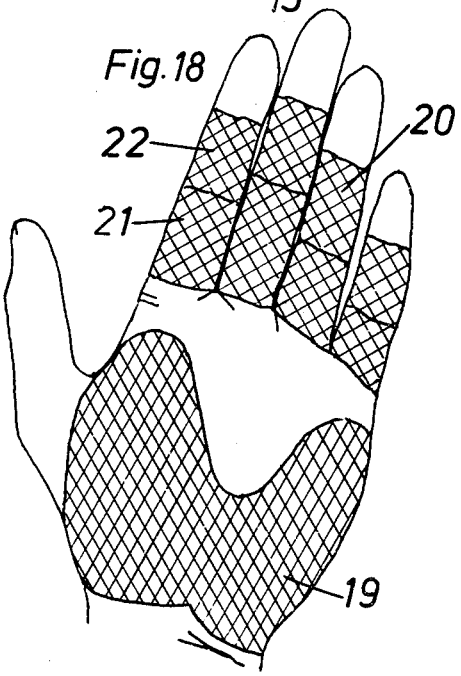
FIG. 18 shows the surfaces of the hand which are the most advantageous ones for applying pressure to the tool and for lifting the tool.

The force of the recoil should be distributed on the highest possible contact surface in order to expose the tissues of the hand to the smallest possible pressure fluctuation as measured per unit of volume of the tissue. Care must also be taken to the allotment of the soft parts of the hand and to the localization of blood-vessels and nerves in the hand. Since it is desired in a percussive tool to make use of as large part of the palm as can be possible for the contact with the handle of the tool, it should be safeguarded that the middle of the palm is subject to a smaller pressure than the side parts. The latter are thicker than the middle of the palm due to the amassing of heavy muscles and subcutaneous fat. In the middle of the palm, on the other hand, heavy muscles do not exist and blood-vessels and nerves lie shallow and also close to the skeleton. Therefore they can easily be exposed to considerable pressure, when being pressed between skin and bone. The part of the palm which has the thickest layer of soft parts and thus can be exposed to higher pressure is depicted by 19 in FIG. 18.

The principle of distributing the pressure fluctuations over a large portion of the palm is highly important in order to decrease the risk that "Reynaud's decease" grows, which is caused by mechanical and possibly thermal effects on blood-vessels and nerves.

Figure 1:
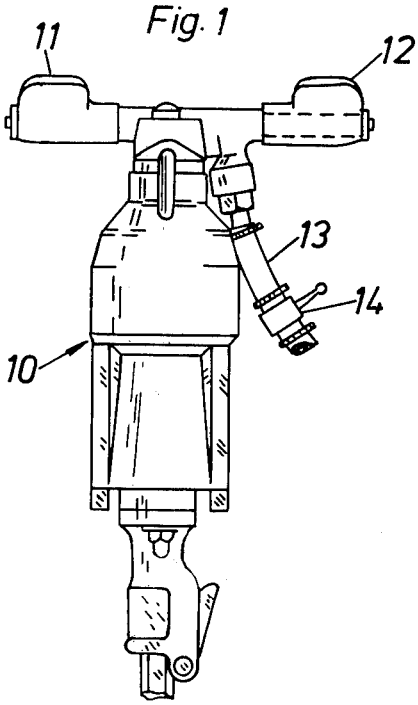
FIG. 1 is a view of a rock drilling machine having a handle according to the invention, seen from the operator.
Figure 2:
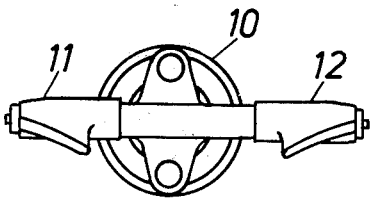
FIG. 2 is a top view of the rock drilling machine in FIG. 1.
Figure 3:
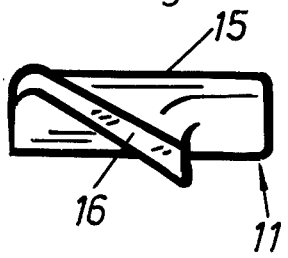
FIG. 3 is a side view of the handle.

In FIGS. 1 and 2 a rock drilling machine 10 is shown having handles 11, 12 designed according to the invention. The rock drilling machine 10 is provided with a conduit 13 for supply of pressure fluid. A valve 14 is inserted in the conduit 13 for controlling the pressure fluid supply.

As shown in FIGS. 3–6 a handle comprises a substantially cylindrical main portion 15 and a wing-shaped portion 16 projecting therefrom. The wingshaped portion 16 extends in the latitudinal direction of the handle and is directed toward the operator. The edge 17 of the portion 16 which faces the tool is intended to form a support for the thumb, and thereby providing an axial terminal stop for the outward movement of the hand along the handle. The edge 17 provides a terminal stop also when the machine is lifted by only one hand for transportation. The upper side of the wing-shaped portion 16 is intended to provide a support for the palm and forming the main pressure surface when a thrust force is applied on the tool.

The wing-shaped portion 16 is preferably designed such that, when pressure is applied on the tool, the contact surface between the hand and the handle has substantially the same extent in the latitudinal and longitudinal directions of the handle. The contact surface is further preferably somewhat concave in order to cause the pressure acting on the middle of the palm to be lower than that acting on surrounding portions.

The wing-shaped portion 16 is preferably obliquely in the longitudinal direction of the handle, whereat the side of said portion which faces the tool 10 is the lowermost one relative to the longitudinal axis of the handle.

As shown in FIGS. 5 and 14–17, the contact surface may be concave in the latitudinal direction of the handle at least at the two axially opposed ends of the wing-shaped portion, preferably concave, however, along the entire axial extent of the portion 16.

Figure 4:
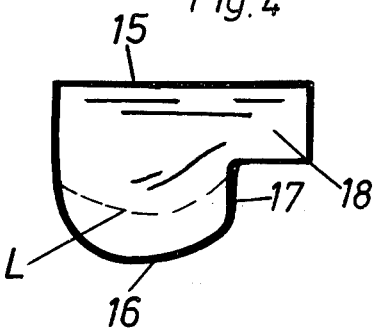
FIG. 4 is a top view of the handle.
Figure 5:
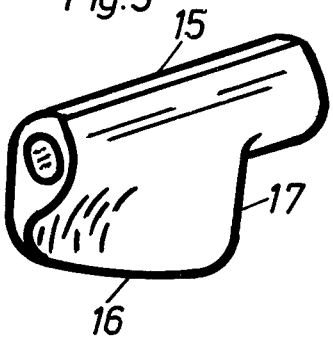
FIG. 5 is a perspective top view of the handle.

The bottom portion L of the concave surface, FIG. 4, is bent in the longitudinal direction of the handle such that the centre of curvature is on the far side of the bottom portion L seen from the operator.

Figure 6:
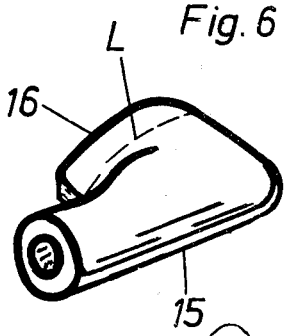
FIG. 6 is a perspective view of the handle, seen towards the operator.

The bottom portion L, FIG. 6, may be convex upwards in the longitudinal direction of the handle.

Figure 8:
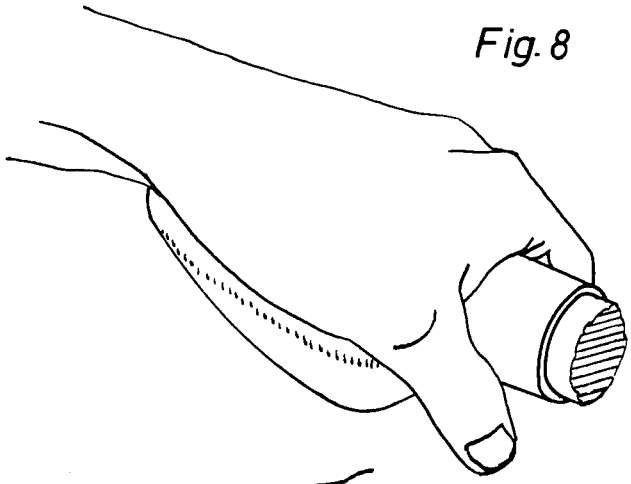
FIGS. 8 and 9 show different perspective views of the grasp of the handle for applying pressure to the tool and directing the tool.
Figure 9:
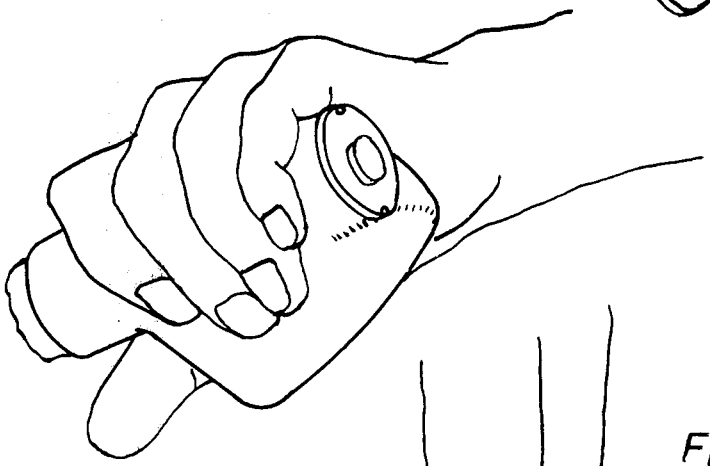

The handle 11 is provided with a cylindrical portion 18 nearest to the tool 10, said cylindrical portion being a contination of the cylindrical main portion 15. In FIGS. 8 and 9 is shown the grasp of the hand on the handle when a thrust force is supplied on the tool.

The lifting of the tool is made easier if the hand can grasp the handle by a closed grip. The handle can be grasped in two ways;

the wrist can be more or less stretched or the wrist can be in an intermediate position between the stretched and bent positions, having the plane of the back of the hand substantially parallel with the longitudinal axis of the forearm.

The first grip makes it possible to more strongly close the hand about the handle, but is unnecessarily tiring if a large force not is required, since extra force of the muscles is needed to hold the hand stretched during lifting and carrying the tool. For lifting a tool the second grip is the more suitable alternative.

When the tool is lifted the pressure caused by the handle should be distributed on the highest possible contact surface of the hand. This contact surface 20 is provided by the bottom and intermediate phalanges 21, 22 of the fingers. When the handle is grasped by a grip of the second type this contact surface is practically a horizontal plane. The handle can therefore to advantage have an almost plate lower horizontal surface.

Figure 7:
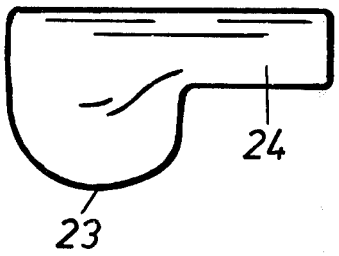
FIG. 7 is a top view of a modified handle.

The lift grip and pressure grip can be arranged side by side overlapping each other as much as possible in order to reduce the moving range of the hand when the grip is changed. The lift grip is placed inwardly of the pressure grip. In FIG. 7 a top view is shown of a handle having axially displaced grips. The wing-shaped portion 23 is designed in the same way as in the embodiment according to FIGS. 3–6. The cylindrical portion 14, which forms the lift grip, however, has been lengthened.

Figure 14:
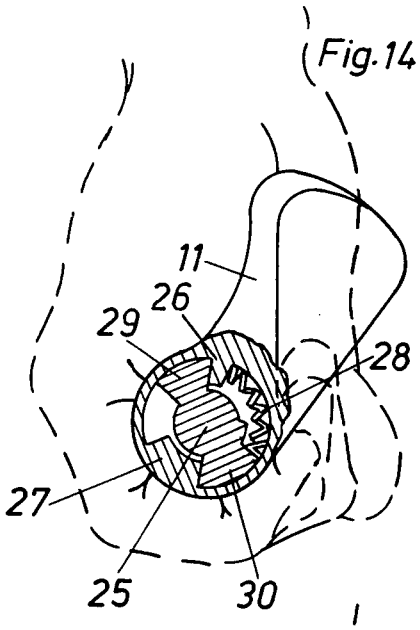
FIGS. 14 and 15 show partly in section a handle, where the operator can change between pressure action and lift action without moving his hand laterally.
Figure 15:
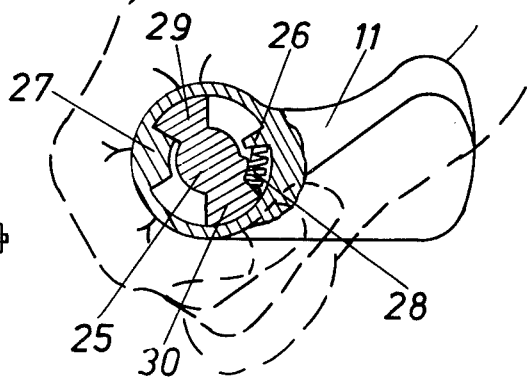
Figure 10:
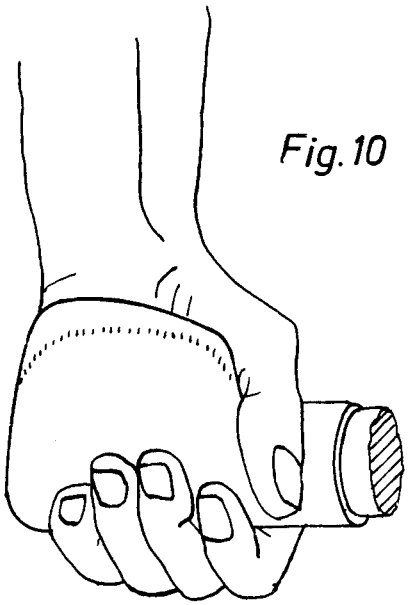
FIG. 10 shows the lifting-grasp of a handle which is designed for combined pressure and lift function.

The two grips can alternatively be mutually arranged in such way that the lift grip is in front of the pressure grip provided that the handle can be turned when pressure action is changed to lift action and vice versa. In FIG. 10 is shown the grasp of the hand about such a turnable handle when the tool is lifted. FIGS. 14 and 15 show, partly in section, the handle at lift action and pressure action respectively. The handle 11 is turnable about a shaft 25. The shaft 25 is provided with diametrically opposed abutments 29, 30. The abutments 29, 30 are intended to form stops for limiting the turning of the handle 12 by cooperation with stop lugs 26, 27 on the handle. A spring 28 is compressed between the stop lug 26 and the abutment 30. The spring 28 seeks to turn the handle to the position shown in FIG. 14.

Figure 16:
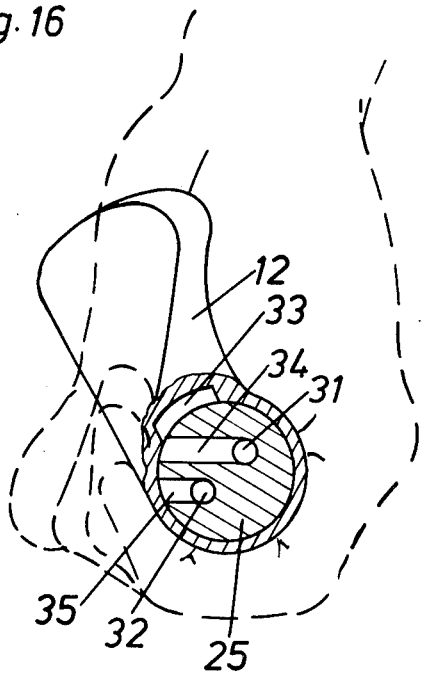
FIGS. 16 and 17 illustrate how a handle according to FIGS. 14 and 15 can be used for controlling the pressure fluid supply to the tool.
Figure 17:
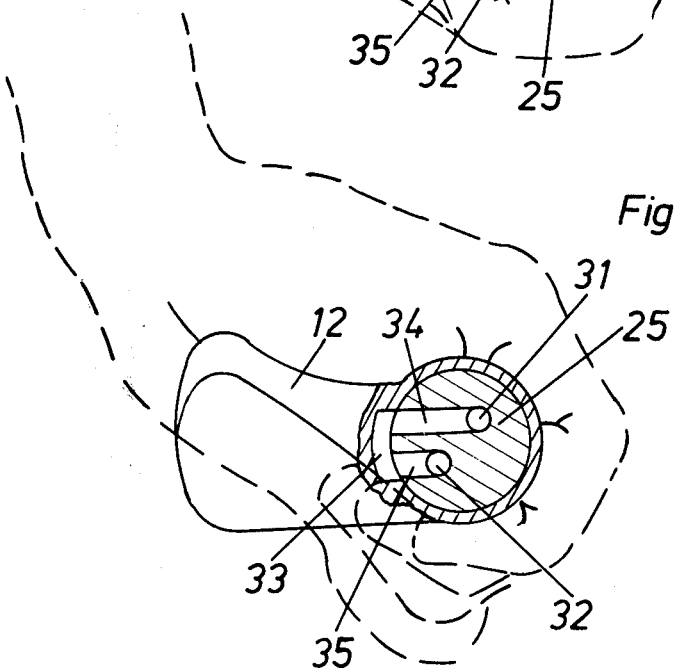

In FIGS. 16 and 17 is shown how the turning of the handle can be used for controlling the supply of pressure fluid to the tool. A channel 31 in the shaft 25 communicates with the conduit 13. A second channel 32 in the shaft 25 communicates with the impactor of the rock drilling machine. A recess 33 is provided in the handle. By turning the handle from lift action to pressure action, the channels 31 and 32 can be interconnected via the recess 33 and transverse channels 34, 35. The handle, thus, will shut off the pressure fluid supply in its lift position and open the supply in its pressure position.

Figure 11:
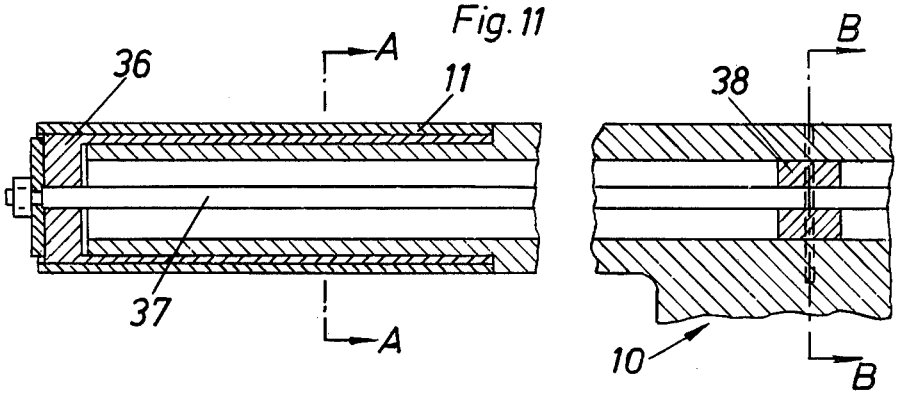
FIG. 11 is a longitudinal section through a resilient hinge connection between handle and tool.

In order to make it possible to apply the force of the recoil far distally in the hand and at the same time provide a contact surface between the handle and the palm which is as large as possible, the handle can to advantage be mounted resiliently by means of a hinge or pivot connection between the handle and the tool. In FIG. 11, the handle 11 is attached to a tubular intermediate piece 36. The intermediate piece 36 is connected to the tool 10 by means of a torsion rod 37, a bushing 38 and a pin 39. When the handle springs, the rod 37 will be tortured. The torsioned rod 37 removes the handle 11 to the position shown in FIG. 12. Lugs 40, 41 on the intermediate piece 36 limit the moving range of the hinge or pivot connection by cooperation with guide bars 42, 43 which project from the tool. The moving range of the hinge or pivot connection must be larger than the amplitude of the recoil.

The various embodiments are in common designed in such way that a person which operates the tool automatically uses the handle in the intended manner. The handle also should be made of a material having a low thermal conductivity.

What we claim is:

1. A handle structure for a hammer tool, said hammer tool recoiling when delivering impacts to a work surface, comprising:

a handgrip (11, 12) for applying pressure thereon so as to force the tool against a material to be worked, said handgrip (11, 12) including a wing-shaped portion (16), said wing-shaped portion (16) projecting toward an operator, the upper side of said wing-shaped portion providing a support for the palm, thereby forming a main pressure surface;

means for pivotally connecting said handgrip to the tool at a forward portion of the handgrip, said forward portion being turned away from the operator and said wingshaped portion extending eccentrically relative to said pivotal connecting means so that recoil forces of the tool are applied eccentrically relative to the hinge of the wrist of an operator; and a lift surface provided in front of said pressure surface, said lift surface resting against the hand of an operator during lifting of the tool, for turning said handgrip about said pivotal connection when changing from lifting action on said lift surface to pressure action on said pressure surface.

2. A handle structure according to claim 1, wherein said wing-shaped portion (16) has an edge (17) which faces the tool and extends in the latitudinal direction of the handgrip and providing a support for the thumb, thereby forming an axial terminal stop for the outward movement of the hand of an operator along the handgrip.

3. A handle structure according to claim 1, wherein the active contact surface between the hand of an operator and the handgrip when pressure is applied on the tool has substantially the same extent in the latitudinal and longitudinal directions of the handgrip.

4. A handle structure according to claim 1, wherein said wing-shaped portion (16) is obliquely directed in the longitudinal direction of the handgrip, the side of said wing-shaped portion which faces the tool being the lowermost part relative to the longitudinal axis of the handgrip.

5. A handle structure according to claim 1, wherein said contact surface is concave in the latitudinal direction of the handgrip at least at the two axially opposed ends of said wing-shaped portion.

6. A handle structure according to claim 5, wherein said contact surface is concave along its entire axial extent.

7. A handle structure according to claim 6, wherein the bottom portion (L) of said concave surface is bent in the longitudinal direction of the handgrip, the centre of curvature of said bend being on the far side of the bottom portion as seen from the operator.

8. A handle structure according to claim 7, wherein said bottom portion (L) is convex upwards in the longitudinal direction of the handgrip.

9. A handle structure according to claim 7, comprising a substantially cylindrical portion (18) adapted to be partly clasped by the thumb and the forefinger of the hand of an operator, said substantially cylindrical portion (18) extending from said wingshaped portion (16) toward the tool (10).

10. A handle structure according to claim 9, wherein the diameter of said cylindrical portion (18) is about half the extent of the portion (16) in said latitudinal direction of the handgrip.

11. A handle structure according to claim 9 wherein said substantially cylindrical portion (24) is adapted to provide a second grip for lifting the tool, the lift surface of said second grip and the pressure surface of the handle being mutually displaced in the longitudinal direction of the handgrip.

12. A handle structure according to claim 1, wherein said pivotal connection is resilient, and the moving range of said pivotal connection exceeds the amplitude of the recoil which occurs when impacts are delivered by the tool.

13. A handle structure according to claim 1, comprising means coupling said handgrip to control the supply of pressure fluid to the tool (FIGS. 16 and 17).

14. A handle structure according to claim 13, wherein said handgrip is adapted to shut off the pressure fluid supply in its lift position and adapted to open the pressure fluid supply in its pressure position.

15. A handle structure according to claim 1, wherein said handgrip forms toward the fingers of the hand of an operator a boundary-line of the contact surface (19), said contact surface transmitting the main pressure between the hand and the handgrip, the middle part of said boundaryline being U-shaped, thereby thrust unloading the middle portion of the palm.

16. A handle structure according to claim 13 wherein said handgrip controls said pressure fluid supply by means of its said turning.

17. A handle structure according to claim 16 wherein said handgrip is adapted to shut off the pressure fluid supply in its lift position and adapted to open the pressure fluid supply in its pressure position.

18. A handle structure according to claim 10, wherein said substantially cylindrical portion (24) is adapted to provide a second grip for lifting the tool, the lift surface of said second grip and the pressure surface of the handle being mutually displaced in the longitudinal direction of the handgrip.

19. A handle structure according to claim 12, wherein said resilient pivotal connection comprises a torsion bar having a first portion anchored in said tool against rotation relative to said tool, and a second portion spaced from said spaced portion along the longitudinal axis of said bar, said second portion being anchored to said handgrip against rotation relative to said handgrip, said torsion bar biasing said handgrip in one of said positions relative to said tool.

20. A handle structure according to claim 12, wherein said resilient pivotal connection comprises spring means coupled between said tool and said handgrip for biasing said handgrip in one of said positions of said handgrip relative to said tool.

21. A handle structure for a hammer tool, said hammer tool recoiling when delivering impacts to a work surface, comprising:

a handgrip (11, 12) for applying pressure thereon so as to force the tool against a material to be worked, said handgrip (11, 12) including a wing-shaped portion (16), said wing-shaped portion (16) projecting toward an operator, the upper side of said wing-shaped portion providing a support for the palm, thereby forming a main pressure surface; and means for pivotally connecting said handgrip to the tool at a forward portion of the handgrip, said forward portion being turned away from the operator and said wingshaped portion extending eccentrically relative to said pivotal connecting means so that recoil forces of the tool are applied eccentrically relative to the hinge of the wrist of an operator;

said pivotal connecting means comprising a resilient pivotal connection which is resiliently turnable from one position to another, the moving range of said pivotal connection exceeding the amplitude of the recoil of the tool when delivering impacts.

22. A handle structure according to claim 21, wherein said resilient pivotal connection comprises a torsion bar having a first portion anchored in said tool against rotation relative to said tool, and a second portion spaced from said spaced portion along the longitudinal axis of said bar, said second portion being anchored to said handgrip against rotation relative to said handgrip, said torsion bar biasing said handgrip in one of said positions relative to said tool.

23. A handle structure according to claim 21, wherein said resilient pivotal connection comprises spring means coupled between said tool and said handgrip for biasing said handgrip in one of said positions of said handgrip relative to said tool.

24. A handle structure according to claim 21, comprising means coupling said handgrip to control the supply of pressure fluid to the tool (FIGS. 16 and 17).

25. A handle structure according to claim 24, wherein said handgrip is adapted to shut off the pressure fluid supply in its lift position and adapted to open the pressure fluid supply in its pressure position.

* * * * *

UNITED STATES PATENT AND TRADEMARK OFFICE

CERTIFICATE OF CORRECTION

PATENT NO. : 4,036,085

DATED : July 19, 1977

INVENTOR(S) : Fritiof Stig SJOSTRAND et al

It is certified that error appears in the above-identified patent and that said Letters Patent are hereby corrected as shown below:

Column 5, line 51, change "the" (second occurrence) to --said wing-shaped--; change "said" to --the--;

Column 6, line 8, change "boundaryline" to --boundary-line--.

Signed and Sealed this

*Twenty-seventh* Day of *September 1977*

[SEAL]

*Attest:*

RUTH C. MASON
*Attesting Officer*

LUTRELLE F. PARKER
*Acting Commissioner of Patents and Trademarks*